US010337095B2

(12) United States Patent
Zhang et al.

(10) Patent No.: US 10,337,095 B2
(45) Date of Patent: Jul. 2, 2019

(54) METHOD AND DEVICE OF SURFACE-TREATING A METALLIC PART

(71) Applicant: Ford Motor Company, Dearborn, MI (US)

(72) Inventors: Kerry Zhang, Nanjing (CN); Michael Puleri, Berkley, MI (US); Jinfeng Chen, Nanjing (CN)

(73) Assignee: Ford Motor Company, Dearborn, MI (US)

( * ) Notice: Subject to any disclaimer, the term of this patent is extended or adjusted under 35 U.S.C. 154(b) by 345 days.

(21) Appl. No.: 15/232,859

(22) Filed: Aug. 10, 2016

(65) Prior Publication Data

US 2017/0044654 A1 Feb. 16, 2017

(30) Foreign Application Priority Data

Aug. 12, 2015 (CN) ..... 2015 1 0493978
Aug. 14, 2015 (CN) ..... 2015 1 0502880

(51) Int. Cl.
*C23C 8/04* (2006.01)

(52) U.S. Cl.
CPC ..... *C23C 8/04* (2013.01)

(58) Field of Classification Search
CPC ..... C23C 8/04
See application file for complete search history.

(56) References Cited

U.S. PATENT DOCUMENTS

| | | | | |
|---|---|---|---|---|
| 2,275,133 A * | 3/1942 | Davis | C23C 8/04 148/210 |
| 2,398,809 A | 4/1946 | Snyder | |
| 2,804,411 A * | 8/1957 | King | C23C 8/00 148/226 |
| 4,035,204 A * | 7/1977 | Hack | C23C 8/04 123/188.8 |
| 5,431,516 A | 7/1995 | Haage et al. | |
| 5,655,864 A | 8/1997 | Haage et al. | |
| 2015/0224535 A1* | 8/2015 | Johnson | B05B 12/24 427/444 |

FOREIGN PATENT DOCUMENTS

| | | |
|---|---|---|
| CN | 203360578 | 12/2013 |
| GB | 1434897 | 5/1976 |
| WO | 2002/066698 | 8/2002 |

* cited by examiner

*Primary Examiner* — Christopher S Kessler
(74) *Attorney, Agent, or Firm* — Burris Law, PLLC

(57) ABSTRACT

In one or more embodiments, a shielding device is provided to shield a bore of a shaft against surface treatment, the shielding device including a sleeve to be at least partially received within the bore, the sleeve defining on its side wall a through-aperture and being of a first cross-sectional dimension when the through-aperture is at a rest position, and a pin to be at least partially received within the sleeve, the sleeve being of a second cross-sectional dimension greater than the first cross-sectional dimension when the through-aperture is at an expanded position with the pin being at least partially received within the sleeve.

12 Claims, 5 Drawing Sheets

METHOD AND DEVICE OF SURFACE-TREATING A METALLIC PART

This application claims foreign priority benefits under 35 U.S.C. § 119(a)-(d) to China Patent Application No. 201510502880.7, filed Aug. 14, 2015, and China Patent Application No. 201510493978.0, Filed Aug. 12, 2015.

FIELD OF THE INVENTION

The disclosed inventive concept relates generally to a method and a device for surface-treating a metallic part.

BACKGROUND OF THE INVENTION

In the field of automobiles, ships or many other mechanical constructions such as aircrafts, mechanical components such as shafts, gears and cams are often required to be of certain wear resistance and surface toughness. To obtain such resistance and toughness, methods such as carburization and/or nitration may be employed for the surface treatment that may be involved.

For instance, China publication CN203360578U discloses a sample carburization method where a protective cover is used to provide certain shielding for the carburization procedure.

For instance also, U.S. publication U.S. Pat. No. 2,398,809 discloses a process of case-hardening hollow metal members where an opening is sealed by glaze-coated ceramic devices.

SUMMARY OF THE INVENTION

One or more embodiments of the present invention relate to a method and a device for surface-treating a metallic part.

According to one aspect of the present invention, a shielding device to shield a bore of a shaft against surface treatment is provided to include: a sleeve to be at least partially received within the bore, the sleeve defining on its side wall a through-aperture and being of a first cross-sectional dimension when the through-aperture is at a rest position; and a pin to be at least partially received within the sleeve, the sleeve being of a second cross-sectional dimension greater than the first cross-sectional dimension when the through-aperture is at an expanded position with the pin being at least partially received within the sleeve.

According to another aspect of the present invention, a method of surface-treating a metallic part is provided, the metallic part including an outer surface abutting a bore extending into an interior of the part, the method includes: positioning a shielding device to be at least partially within the bore, the shielding device including a pin and a sleeve at least partially positioned between the pin and an interior wall defining the bore, the sleeve including on its side wall a through-aperture for expansion along a cross-sectional direction such that the sleeve is a first cross-sectional dimension and a greater second cross-sectional dimension respectively before and after the pin is at least partially received within the sleeve.

According to yet another aspect of the present invention, a shielding device to shield a bore of a metallic part against surface treatment is provided to include: a metallic sleeve to be at least partially received within the bore, the sleeve defining on its side wall first and second through-apertures and being of a first cross-sectional dimension when the through-aperture is at a rest position; and a pin to be at least partially received within the sleeve, the sleeve being of a second cross-sectional dimension greater than the first cross-sectional dimension when the through-aperture is at an expanded position with the pin being at least partially received within the sleeve, where a cross-section of the sleeve defines a first portion of the first through-aperture and a second portion of the second through-aperture.

It is appreciated that the Summary of the Invention provided above is to briefly introduce a few concepts that are further described in the Detailed Description. It is not meant to identify key or essential features of the claimed subject matter, the scope of which is defined uniquely by the Claims that follow the detailed description. Furthermore, the claimed subject matter is not limited to any particular examples described herein.

One or more advantageous features as described herein are believed to be readily apparent from the following detailed description of one or more embodiments when taken in connection with the accompanying drawings.

BRIEF DESCRIPTION OF THE DRAWINGS

Reference is now be made to the one or more embodiments illustrated in greater detail in the accompanying drawings and described below wherein.

DETAILED DESCRIPTION OF ONE OR MORE EMBODIMENTS

Figure 1:
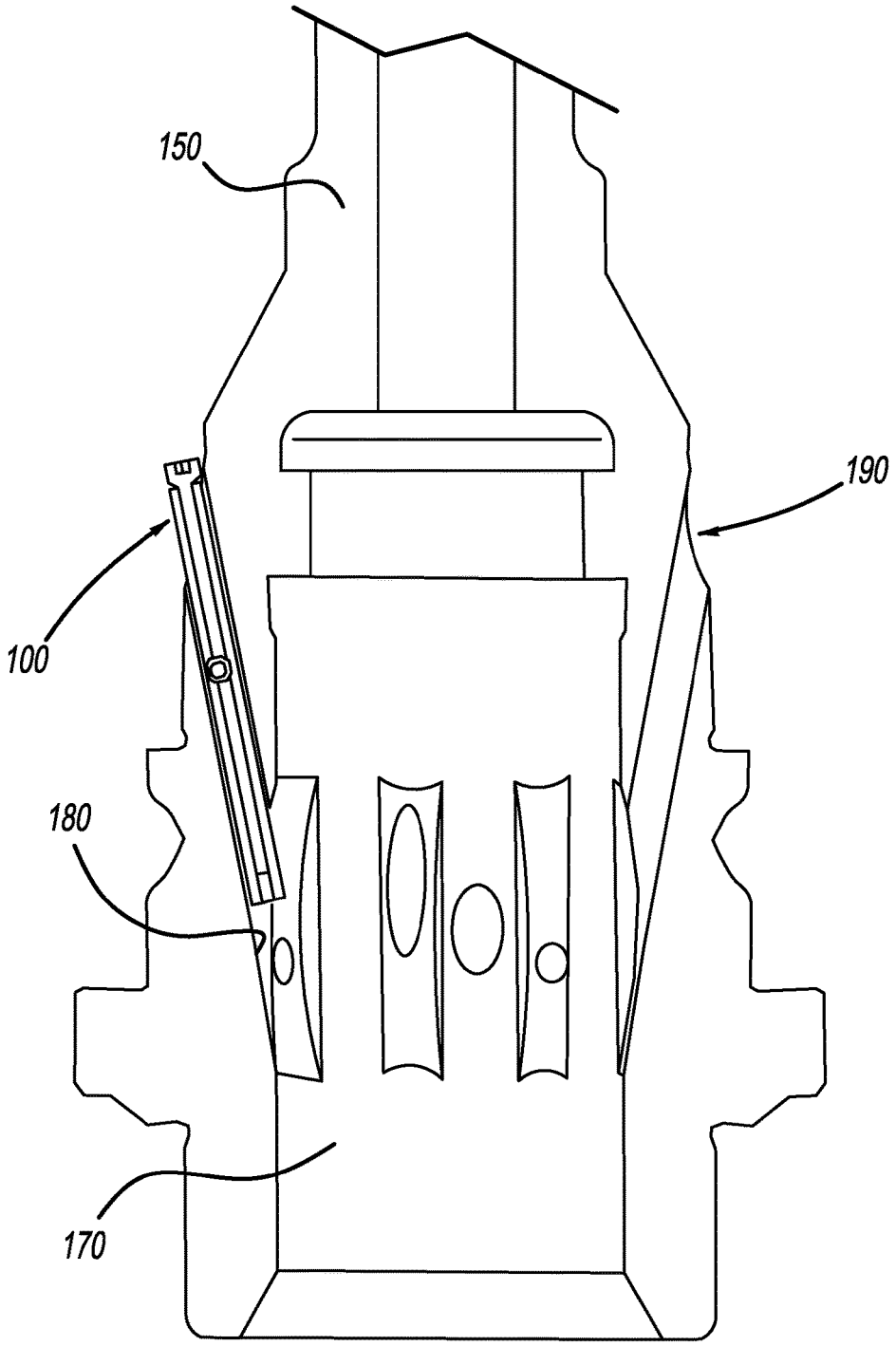
FIG. 1 illustratively depicts a metallic part having a bore with a shielding device at least partially received therein according to one or more embodiments of the present invention.

As referenced in the figures, the same reference numerals may be used herein to refer to the same parameters and components or their similar modifications and alternatives. These parameters and components are included as examples and are not meant to be limiting. The drawings referenced herein are schematic and associated views thereof are not necessarily drawn to scale.

The present invention in one or more embodiments is advantageous at least in providing a device and a method of surface-treating a metallic part where certain portions thereof may be effectively shielded from the surface treatment to facilitate downstream processes where such shielding is beneficial and sometimes necessary. The metallic part may be used in mechanical fields and the herein-mentioned surface treatment may be employed to provide for relatively more enhanced mechanical performance such as performance in areas of surface hardness and wear-resistance. Non-limiting examples of the metallic part that may benefit from the method and device of the present invention in one or more embodiments include metallic shafts such as worm shafts and sector shafts, gears, cams and other similar components that may be used in vehicles and other suitable constructions such as ships and aircrafts.

As mentioned herein elsewhere, the method and device of surface treatment according to the present invention in one or more embodiments is further advantageous therefore by being set apart from certain existing designs or methods employing the use of a masking coating, which aims to apply a coating onto the bore as a mask to shield against surrounding surface treatment, and which however, may be labor-intensive and cost-prohibitive. Moreover, there does not appear to be a straightforward way of determining whether such masking coating is satisfactorily complete such that there are no undesirable bare spots where masking coating does not reach. Moreover, there does not appear to be a definite methodology to make certain that the masking coating does not in any undesirable way interfere with the targeted surface treatment or that unwanted side reactions between the masking coating material and the targeted surface treatment material do not substantially result. As detailed herein elsewhere, the present invention in one or more embodiments is believed to provide a surface treatment method where one or more of these insufficiencies involved in certain existing designs may be avoided.

For brevity, embodiments of the present invention are described in the context of a worm shaft of a steering assembly where an elongated bore is shielded from a targeted surface treatment to an outer surface of the worm shaft. It should be appreciated that the present invention in one or more embodiments may be employed to surface-treat any other suitable parts such as cams and shafts that may be found in automobiles, ships and/or aircrafts.

FIG. 1 illustratively depicts a metallic part 190, such as a shaft, having a bore 180 extending into an interior 170 of the metallic part 190, with a shielding device 100 at least partially received therein according to one or more embodiments of the present invention. The metallic part 190 may be a worm shaft employed in a steering unit of a vehicle for instance. Surface treatment such as carburization may be employed onto an outer surface 150 of the metallic part 190 to provide for certain desirable surface hardness and wear-resistance of the metallic part 190, while the bore 180 is to be shielded from the surface treatment to facilitate certain downstream processes. Without wanting to be limited to any particular theory, it is believed that keeping the bore 180 shielded away from the carburization may be desirable to maintain certain structural and material stability and to reduce unwanted deformation of the bore 180. On the other hand, if machining of the bore 180 has been carried out prior to the carburization, size and configuration of the bore 180 may then be effected, often negatively, by the temperatures involved in the carburization. Accordingly, the bore 180 may then have to be machined again after the carburization, such that unnecessary waste in time, money and labor may result. In certain instances, the combination of the first machining and the following carburization may render the bore 180 no longer suitable for a second step of machining.

Figure 2A:
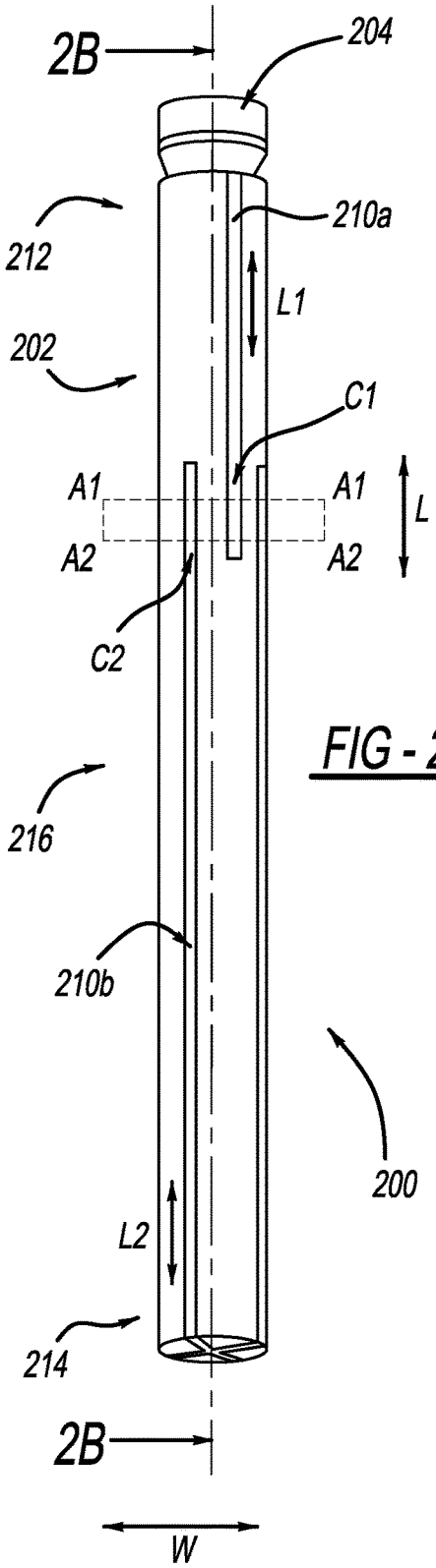
FIG. 2A illustratively depicts a perspective view of the shielding device referenced in FIG. 1 including a sleeve and a pin at least partially received therein.
Figure 2B:
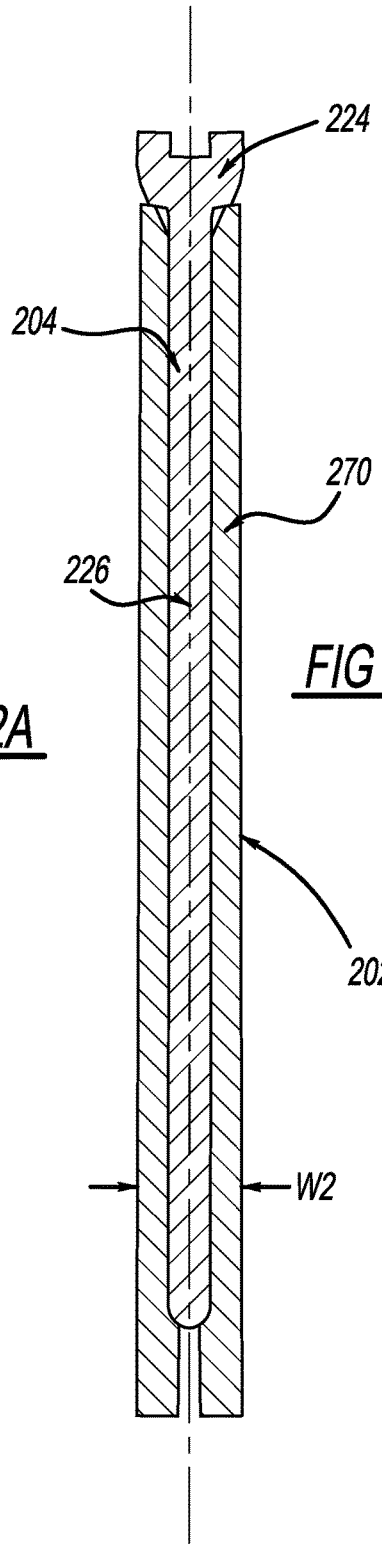
FIG. 2B illustratively depicts a cross-sectional view of the shielding device referenced in FIG. 2A.

FIG. 2A and FIG. 2B illustratively depict a perspective view and a cross-sectional view respectively of a shielding device 200 as a non-limiting example of the shielding device 100 referenced in FIG. 1, where the shielding device 200 is provided to shield the bore 180 of the shaft 190 referenced in FIG. 1 against surface treatment, for instance carburization.

Figure 2C:
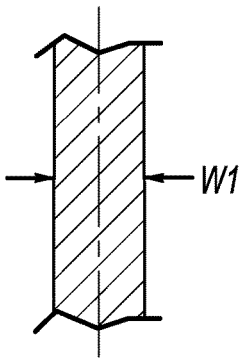
FIG. 2C illustratively depicts a cross-sectional view of the sleeve of the shielding device referenced in FIG. 2A at a rest position prior to the receipt therein of the pin.

Referring back to FIG. 2A, the shielding device 200 includes a sleeve 202 to be at least partially received within the bore 180, and a pin 204 to be at least partially received within the sleeve 202, the sleeve 202 defining on its side wall 270 a first through-aperture 210*a*, where the sleeve 202 is of a first cross-sectional dimension W1 when the first through-aperture 210*a* is at a rest position prior to the receipt of the pin 204 as illustratively depicted in FIG. 2C, and is of a second cross-sectional dimension W2 greater than the first cross-sectional dimension W1 when the first through-aperture 210*a* is at an expanded position with the pin 204 being at least partially received within the sleeve 202.

With the sleeve 202 being at least partially received within the bore 180, with the pin 204 in turn being at least partially received within the sleeve 202, and with the subsequent radial expansion of the sleeve 202 along direction W from its first cross-sectional dimension W1 to its second cross-sectional dimension W2 due to the receipt of the pin 204, the shielding device 200 may be in a desirably close contact with the bore 180 due to the radial expansion and is believed to reduce or prevent any unwanted intrusion into the bore 180 of a surface treatment material and accordingly effectively to shield the bore 180 from the surface treatment.

As mentioned herein elsewhere, the shielding device 200 and its associated shielding method are particularly useful and beneficial when the bore 180 is of an elongated configuration such as the one illustratively depicted in FIG. 1, where portions of the bore 180 that are deeper into an interior of the part 190 may not be readily accessible to chemical or coating masking per certain existing methods and therefore may easily be contacted with unwanted surface treatment material involved in the targeted surface treatment to the part 190.

Along this line of benefits also, any unwanted presence of the surface treatment material on the bore 180 may be easily detectable and thus shielding efficiency may be readily determined by the amount of the surface treatment material, if any, present on the bore 180. Therefore, the shielding may be carried out according to the present invention in one or more embodiments with relatively enhanced efficiency and reduced operational errors. It is often very difficult, if not all impossible, to detect whether carburization unwantedly occurs within a bore, or to determine the extent of a carburization process. In one sense, carburization is similar to a heated air conditioned room, which a batch of parts may be sent into for a first period of time and then retrieved out from. This process may repeat again with another batch of parts. The physical shielding according to one or more embodiments of the present invention is thus advantageous where effectiveness of shielding may easily be ascertained by the depth and/or level of insertion of the shielding device into the bore.

Referring back to FIG. 1 through FIG. 2B, the shielding device 200 in one or more embodiments of the present invention may include a metallic material, where the metallic material may be present in the sleeve 202, in the pin 204, or both. The metallic material may include any suitable metals and/or metal alloys. In a non-limiting example, the metallic material includes copper or a copper alloy. Without wanting to be limited to any particular theory, copper is believed to be resistant to carburization and is also of acceptable ductility. In the event that copper is specifically included in the sleeve 202, copper may deform and closely contact the bore 180 in the metallic part 190 when the pin 204 is inserted into the sleeve 202.

Referring back again to FIG. 2A and FIG. 2B, the sleeve 202 may include first and second end portions 212, 214 and a body portion 216 positioned there-between along a longitudinal direction L, a length-to-width ratio L/W of the sleeve 202 being greater than 2, greater than 5, or greater than 10. As mentioned herein elsewhere, this elongation feature of the bore 180 is believed to impart particular difficulties if one were to use the masking coating as a way of providing shielding, simply because providing a reasonably uniform coating within a bore with such a L/W would be difficult if not all impossible. Accordingly the present invention in one or more embodiments is once again advantageously set apart from these existing shielding by coating efforts.

Referring back again to FIG. 2A and FIG. 2B, the sleeve 202 may further include a second through-aperture 210*b* which, along with the first through-aperture 210*a*, may be collectively referred to as a through-aperture 210. In certain other embodiments, through-apertures additional to the first and second through-apertures 210*a*, 210*b* may be employed to provide greater expandability of the sleeve 202 as desirable.

The first through-aperture 210*a* may be at least partially positioned at the first end portion 212 of the sleeve 202 and the second through-aperture 201*b* may be at least partially positioned at the second end portion 214 of the sleeve 202. Accordingly, the sleeve 202 may be expandable along direction L both at the first end portion 212 by the presence of the first through-aperture 210*a* and at the second end portion 214 by the presence of the second through-aperture 210*b*.

In a non-limiting embodiment, the first and second through-aperture 210*a* and 210*b* may be provided in such a manner that a cross-section Q of the sleeve 202 along lines A1-A1 and A2-A2 defines a first portion C1 of the first through-aperture 210*a* and a second portion C2 of the second through-aperture 210*b*. This configuration indicates that the first and second through-apertures 210*a*, 210*b* are both present at least in the cross-section Q of the sleeve 202, where greater expandability along direction W may be expected. The first and second through-apertures 210*a* and 210*b* thus provided are believed to provide desirable shielding to the bore 180 from surface treatment.

In certain embodiments, the first aperture 210*a* may extend along a first direction L1 and the second aperture 210*b* may extend in a second direction L2 different from L1. L1 and/or L2 may be of any suitable angle to the longitudinal direction L, and the angle may be zero. In the event that the through-aperture 210 in general includes through-apertures other than the first and second through-apertures 210*a*, 210*b*, these additional through-apertures may be of any suitable extending directions and as a result, expansion of the sleeve 202 may be realized at any suitable location thereof with any suitable extent.

Referring back again to FIG. 2B, the pin 204 includes a head portion 224 with a cross-sectional dimension greater than that of a waist portion or body portion 226 of the pin 204. The head portion 224 may accordingly provide improved shielding performance during surface treatment such that surface treating material/media will not leak into the bore 180 through the aperture 210.

Figure 3A:
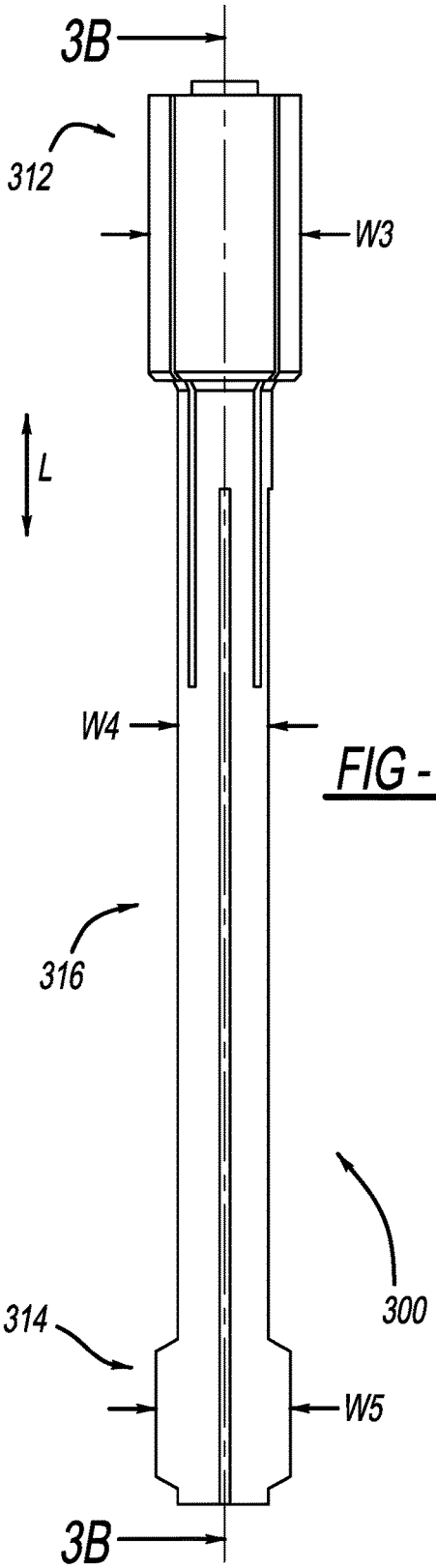
FIG. 3A illustratively depicts an alternative perspective view of the shielding device referenced in FIG. 1.
Figure 3B:
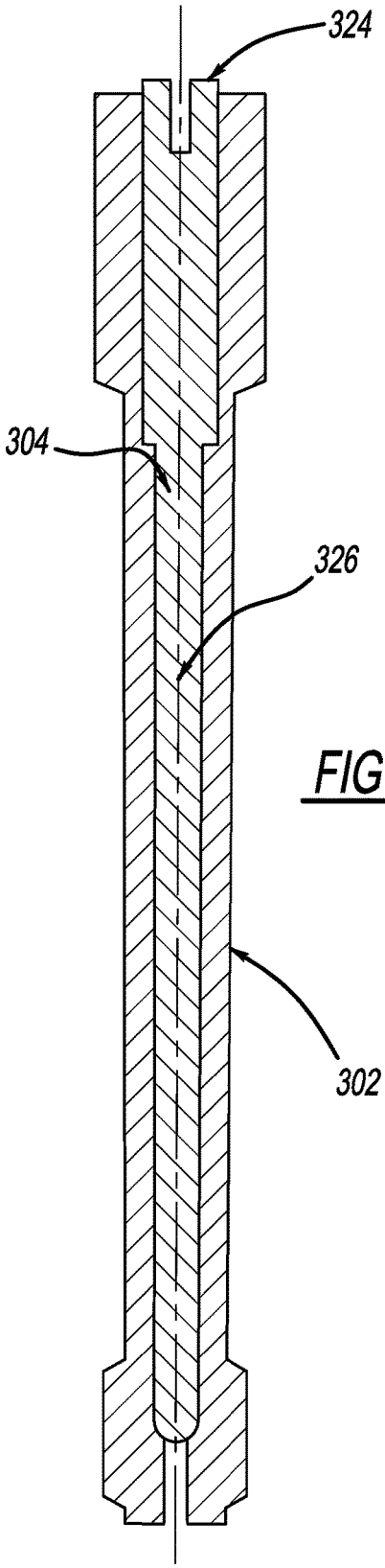
FIG. 3B illustratively depicts a cross-sectional view of the shielding device referenced in FIG. 3A.

FIG. 3A and FIG. 3B illustratively depict a perspective view and a cross-sectional view thereof of a shielding device 300 as an alternative to the shielding device 100 referenced in FIG. 1, where the shielding device 300 includes a sleeve 302 to be at least partially received within the bore 180 and a pin 304 to be in turn at least partially received within the sleeve 302.

Referring back to FIG. 3A and FIG. 3B, the sleeve 302 may include a first and a second end portion 312, 314 and a body portion 316 positioned there-between along direction L, and the pin 304 may include a head portion 324 and a body portion 326. The shielding device 300 may be configured similarly as the shielding device 200, yet with a noticeable difference which lies in the cross-sectional dimension ratio between the head portion 312 relative to the body portion 316 at a rest position prior to the receipt of the pin 324, at an expanded position with the pin 324 received therein, or at both positions. In particular, the first end portion 312 may be of a cross-sectional dimension W3 greater than a cross-sectional dimension W4 of the body portion 316. In certain embodiments, the second end portion 314 may also be of a cross-sectional dimension W5 greater than the cross-sectional dimension W4 of the body portion 316. In this configuration, enlarged end portions of the sleeve 302 are believed to provide further enhanced shielding performance and efficiency against surface treatment material from entering into or contacting the bore 180.

Figure 4A:
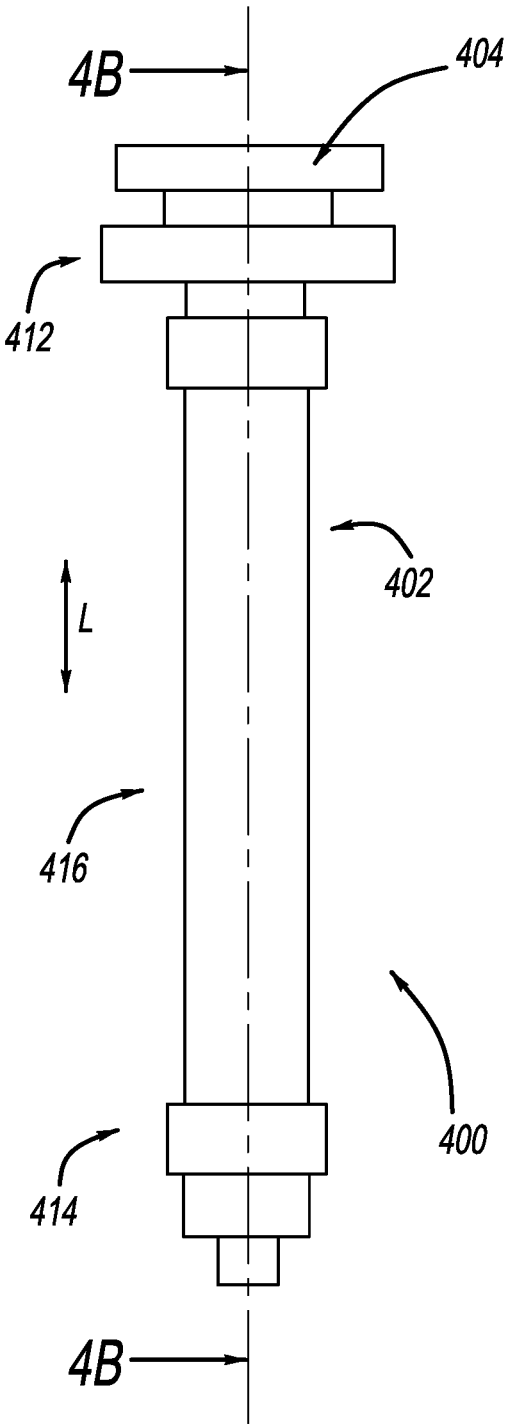
FIG. 4A illustratively depicts yet another alternative perspective view of the shielding device referenced in FIG. 1.
Figure 4B:
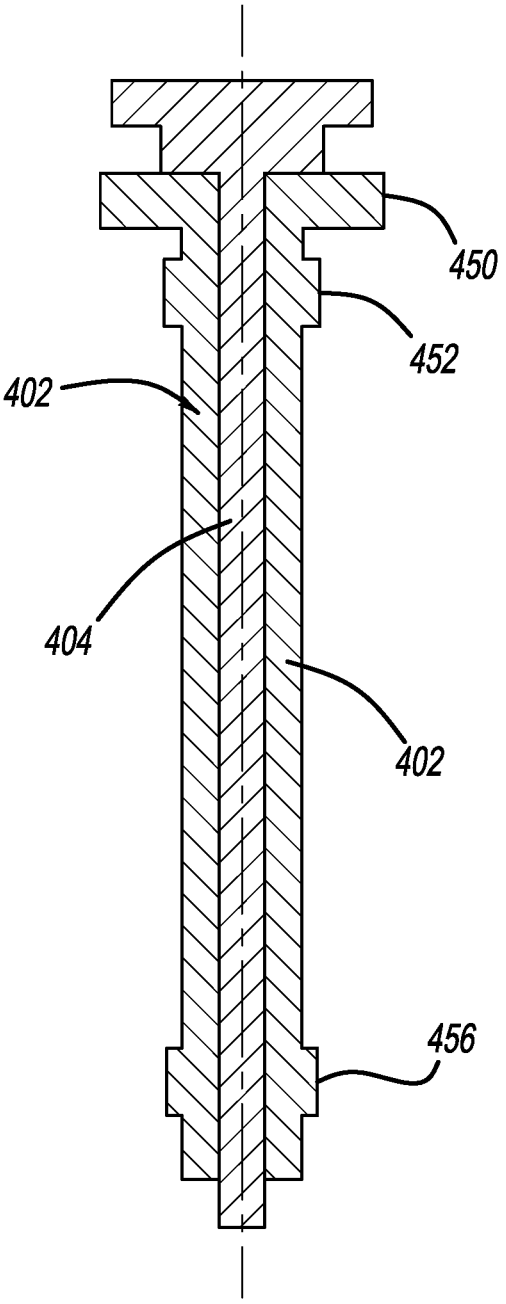
FIG. 4B illustratively depicts a cross-sectional view of the shielding device referenced in FIG. 4A.

FIG. 4A and FIG. 4B illustratively depict a perspective view and a cross-sectional view, respectively, of a shielding device 400 as an alternative to the shielding device 200 referenced in FIG. 2A and FIG. 2B and/or as an alternative to the shielding device 300 referenced in FIG. 3A and FIG. 3B, where the shielding device 400 may include a sleeve 402 to be at least partially received within the bore 180 and a pin 404 in turn to be at least partially received within the sleeve 402.

Referring back to FIG. 4A and FIG. 4B, the sleeve 402 may include a first and a second end portion 412, 414 and a body portion 416 positioned there-between along direction L. The shielding device 400 may be configured similarly as the shielding device 200 or the shielding device 300, yet with a noticeable difference which lies in the configuration of the first end portion 412. In particular, the first end portion 412 may include a first lip 450 and a second lip 452 positioned between the first lip 450 and the body portion 416, where the first lip 450 differs from the second lip 452 in cross-sectional dimension. More particularly, the first lip 450 may have a greater cross-sectional dimension than the second lip 452. This configuration is believed to provide additional prevention to the bore 180 from being contacted by the surface treatment material, where the second lip 452 may be contacting the bore 180 as a first shielding defense and the first lip 450 may be contacting an opening edge or rim of the bore 180 as a second shielding defense.

In certain embodiments, and as illustratively depicted in FIG. 4A and FIG. 4B, the second end portion 414 may include a third lip 456 to adopt similar functional features as the first lip 450 and/or the second lip 452, where the third lip 456 is of a cross-sectional dimension greater than that of the body portion 416.

Figure 5:
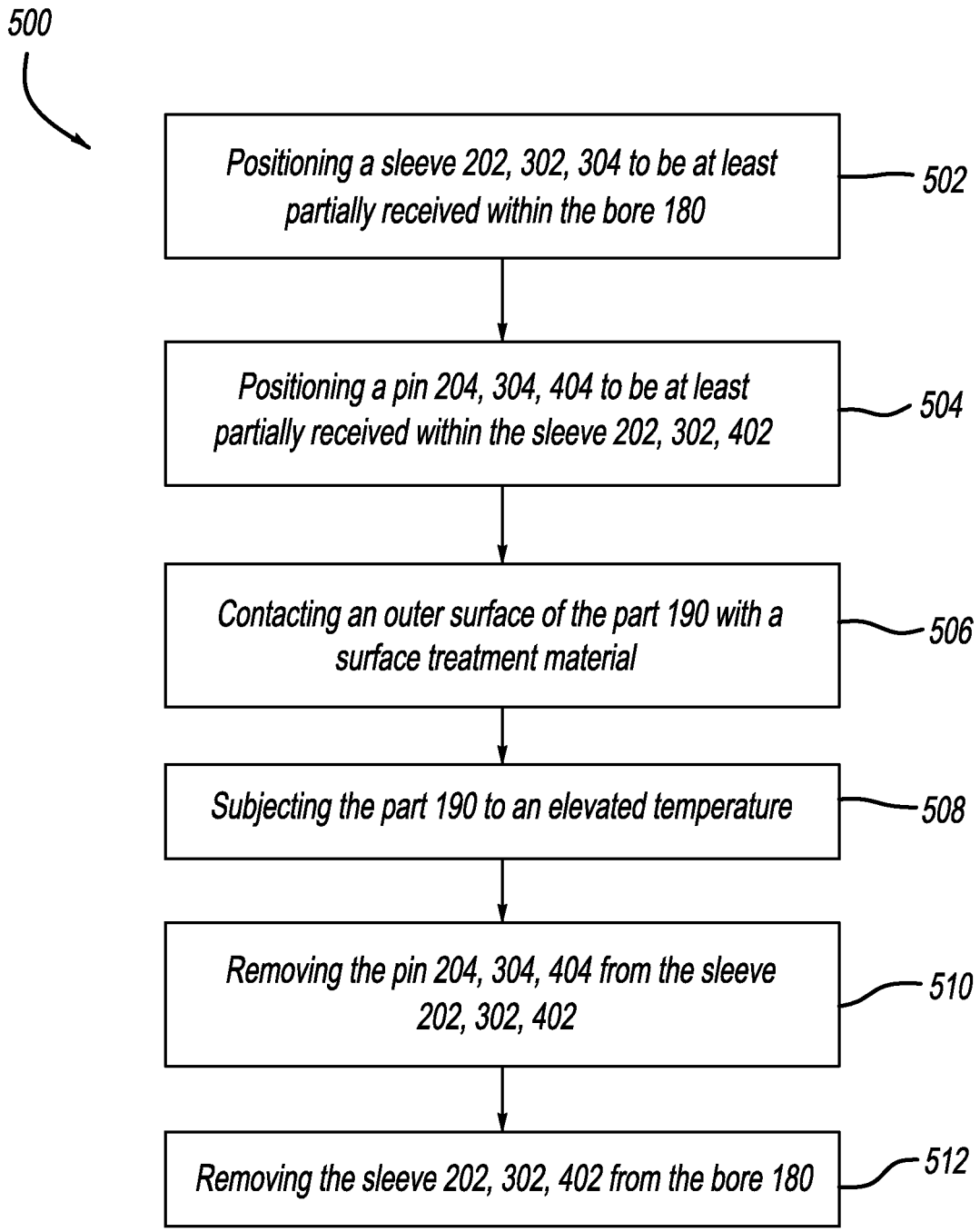
FIG. 5 illustratively depicts an exemplary process flow of surface-treating the part referenced in FIG. 1 using any one of the shielding device referenced in FIG. 2A through FIG. 4B.

FIG. 5 depicts an exemplary process flow of surface treating the part 190 as referenced in FIG. 1 using any one of the shielding devices 200, 300 and 400 referenced in FIG. 2A through FIG. 4B, where the part 190 may be a worm shaft, a cam, a gear or a sector shaft where the part 190 defines the bore 180 and where it is desirable for the bore 180 to be shielded away from the surface treatment.

Referring back to FIG. 5, at step 502, prior to contacting the part 190 with the surface treatment material, any one of the sleeve 202, 302, 402 of the shielding device 200, 300, 400 may be positioned to be at least partially received within the bore 180 of the part 190.

At step 504, any one of the pin 204, 304, 404 of the shielding device 200, 300, 400 may be positioned to be at least partially received within the sleeve 202, 302, 402 such that the sleeve 202, 302, 402 becomes of a greater cross-section after the receipt of the pin 204, 304, 404 and is thus expanded. The expansion is believed to place a temporarily shielding of the bore 180 against unwanted contact by the surface treatment material and readies the bore 180 for the next step.

At step 506, the outer surface of the part 190 is then contacted with the surface treatment material, which may be a carbon-containing material in the event when the surface treatment is carburization.

At step 508, the method 500 further includes subjecting the part 190 to an elevated temperature. It is appreciated that the step 502 of providing the sleeve 202, 302, 402 may be carried out after the step 504 of contacting the outer surface of the part 190 with the surface treatment material as long as substantial surface treatment has not effectuated, such as before the step 508 of subjecting the part 190 to an elevated temperature.

Thereafter, the shielding device 202, 302, 402 is removed from the bore 180 and the part 190 is ready for any subsequent treatments as suitable and necessary. The removal may be carried out, for instance at step 510, by first removing the pin 204, 304, 404, which is then followed by the removal of the sleeve 202, 302, 402 at step 512. The steps involved in the removal of the shielding device 200, 300, 400 is thus in reverse order to the steps involved in the positioning of the shielding device 200, 300, 400 into the bore 180. As mentioned herein elsewhere, the order is particularly beneficial at least in that the pin 204, 304, 404 helps secure the radial expansion and hence the positioning of the sleeve 202, 302, 402 within the bore 180; for the same token, removal of the pin 204, 304, 404 from the sleeve 202, 302, 402 renders the latter transform from the expanded position to its rest position and its subsequently readily removal from the bore 180.

In one or more embodiments, the present invention as set forth herein is believed to have overcome certain challenges associated with shielding a bore of a part against surface treatment such as carburization. In particular, and as mentioned herein elsewhere, the at least partial receipt of the sleeve 202, 302, 402 within the bore 180 functions to pre-condition the bore 180 by providing a channel relatively more suitable to receive there-in the pin 204, 304, 404. With the at least partial insertion therein of the pin 204, 304, 404, the sleeve 202, 302, 402 expands radially for instance along direction W, and the expansion functions to form a relatively tight coverage on and hence shielding of the bore 180 against unwanted intrusion of the surface treatment material. In addition, the through-apertures may be positioned at any suitable locations on the sleeve 202, 302, 402, and therefore coverage and shielding of the bore 180 may be easily customized as desirable. However, one skilled in the art will readily recognize from such discussion, and from the accompanying drawings and claims that various changes, modifications and variations can be made therein without departing from the true spirit and fair scope of the invention as defined by the following claims.

What is claimed is:

1. A method of carburizing and/or nitriding a metallic part, comprising:

positioning a shielding device to be at least partially within a bore, the shielding device including a pin and a sleeve at least partially positioned between the pin and an interior wall defining the bore, the sleeve including on its side wall a through-aperture for expansion along a cross-sectional direction such that the sleeve is a first cross-sectional dimension and a greater second cross-sectional dimension respectively before and after the pin is at least partially received within the sleeve.

2. The method of claim 1, wherein the positioning step is carried out such that the sleeve is positioned at least partially within the bore prior to the pin being positioned at least partially within the sleeve.

3. The method of claim 1, further comprising contacting an outer surface of the metallic part with a carbon-containing material.

4. The method of claim 3, wherein the contacting step is carried out subsequent to the positioning step.

5. The method of claim 1, further comprising subjecting a shaft comprising the bore to an elevated temperature.

6. The method of claim 1, wherein the sleeve includes first and second end portions and a body portion positioned there-between along a longitudinal direction, a length-to-width ratio of the sleeve being greater than two, and the first end portion being at least partially outside of the bore when the sleeve is in an expanded position.

7. The method of claim 6, wherein the through-aperture includes first and second through-apertures at least one of which being at least partially positioned at the first end portion of the sleeve.

8. The method of claim 6, wherein the through-aperture includes a first through-aperture at least partially positioned at the first end portion and a second through-aperture at least partially positioned at the second end portion of the sleeve.

9. The method of claim 6, wherein at least one of the first and second end portions includes a first lip and a second lip positioned between the first lip and the body portion, the first lip being different from the second lip in cross-sectional dimension.

10. The method of claim 1, wherein the through-aperture includes first and second through-apertures, a cross-section of the sleeve defining a first portion of the first through-aperture and a second portion of the second through-aperture.

11. The method of claim 1, wherein the through-aperture includes a first aperture extending along a longitudinal direction and a second aperture extending in a second direction different from the longitudinal direction.

12. The method of claim 1, wherein the pin includes a head portion with a cross-sectional dimension greater than that of a waist portion of the pin.

* * * * *